United States Patent [19]

Kawaguchi

[11] Patent Number: 4,817,063

[45] Date of Patent: Mar. 28, 1989

[54] POWER SOURCE CONTROL CIRCUIT FOR AN ANALOG ELECTRONIC TIMEPIECE

[75] Inventor: Takashi Kawaguchi, Suwa, Japan

[73] Assignee: Seiko Epson Corporation, Tokyo, Japan

[21] Appl. No.: 148,535

[22] Filed: Jan. 26, 1988

[30] Foreign Application Priority Data

Jan. 26, 1987 [JP] Japan ..... 62-15423

[51] Int. Cl.[4] ..... G04B 1/00

[52] U.S. Cl. ..... 368/204

[58] Field of Search ..... 368/204, 157, 160

[56] References Cited

U.S. PATENT DOCUMENTS 4,358,728 11/1982 Hashimoto ..... 368/204

4,395,138 7/1983 Chihara ..... 368/204

4,441,825 4/1984 Morokawa ..... 368/204

*Primary Examiner*—Bernard Roskoski

*Attorney, Agent, or Firm*—Blum Kaplan

[57] ABSTRACT

An analog electronic timepiece powered by a battery, which prevents malfunctions of the divider circuits within the timepiece during periods of high load is provided. An oscillator circuit produces a high frequency time standard signal. A divider circuit divides the high frequency time standard signal to a low frequency time standard signal. An analog display means provides a visual indication of the time. A drive circuit including a drive coil and a motor is coupled to the divider circuit and analog display means and produces drive pulses in responses to the low frequency drive signals to drive the analog display means. The DC resistance of the drive coil is at least twice as great as the internal resistance of the battery. A first time constant of the battery associated with the reduction of battery output voltage during driving pulses and a second time constant associated with restoring battery output voltage after the driving pulse are both greater than 200 msec when the internal resistance of the battery is greater than 100Ω. A regulating circuit coupled to the battery, oscillator circuit and divider circuit receives the battery output voltage and outputs a regulated voltage to the oscillator circuit and divider circuit.

7 Claims, 2 Drawing Sheets

POWER SOURCE CONTROL CIRCUIT FOR AN ANALOG ELECTRONIC TIMEPIECE

BACKGROUND OF THE INVENTION

This invention relates to a battery powered analog electronic timepiece, more particularly, an analog electronic timepiece which prevents malfunctions of the divider circuits within the time piece during periods of high load.

Battery powered analog electronic timepieces are known in the art and generally include a battery power source, such as a lithium battery. However, the internal resistance of the lithium battery may and does vary depending upon the handling and environment of the battery. As a result, the voltage of the battery suddenly varies when there are changes in these conditions and malfunctions of the divider circuits result.

Prior art timepieces include a voltage regulating circuit or a voltage converting circuit, for converting a high output voltage to a low output voltage, between the power source and the divider circuits to reduce current consumption of the circuit which shortens the life of the battery. However, malfunctions resulting from variations in the internal resistance of the battery and the battery voltage output may still occur. Accordingly, to stabilize the output voltage a capacitor is coupled to the voltage regulating circuit to prevent divider circuit malfunctions. A voltage converting circuit which converts a high input voltage from the power source to a lower output voltage may also be used along with the capacitor so that the output voltage remains substantially constant as the battery output voltage varies.

These prior art devices have provided satisfactory performance however, utilizing a capacitor with the voltage regulation circuit or a voltage converting circuit, increase the number of components necessary for a properly functioning analog timepiece. This results in an increase in the physical size of the timepiece to accomodate the extra circuit area as well as an increase in cost. Accordingly, it is desirable to provide a battery powered electronic analog timepiece which overcomes the shortcomings of the prior art devices described above.

SUMMARY OF THE INVENTION

Generally speaking, in accordance with the invention, a battery powered analog electronic timepiece, constructed of a limited number of operating parts, is provided. A battery power source has an internal resistance greater than 100Ω given the handling and environment of the battery. An oscillator produces a time standard high frequency signal. A divider circuit converts the high frequency standard signal to a low frequency standard signal. A drive circuit provides drive pulses to a drive motor, having a coil, which drives an analog time display. The time constant of the reduction of battery voltage and the time constant of the restoration of battery voltage after production of the motor driving pulse are both more than 2 μsec. The DC resistance of the motor coil is at least twice as great as the internal resistance of the battery. A voltage regulating circuit receives the battery voltage and provides a regulated voltage to the divider circuit and oscillator.

Accordingly, it is an object of the invention to provide an improved battery powered electronic analog timepiece.

Another object of the invention is to provide an analog timepiece constructed of a limited number of components which prevents malfunctions resulting from variations in the voltage source.

A further object of the invention is to provide a battery powered analog timepiece which prevents malfunctions resulting from variations in battery voltage at a low cost.

Yet another object of the invention is to provide an analog electronic timepiece which assures that the battery has sufficient time to recharge between pulses by matching the resistance of the motor coil to an expected range of internal battery resistances.

Still other objects and advantages of the invention will in part be obvious and will in part be apparent from the specification and drawings.

The invention accordingly comprises features of construction, combinations of elements and arrangements of parts which will be exemplified in the construction herein set forth and the scope of the invention will be indicated in the claims.

BRIEF DESCRIPTION OF THE DRAWINGS

For a fuller understanding of the invention, reference is had to the following description, taken in connection with the accompanying drawings, in which.

DETAILED DESCRIPTION OF THE PREFERRED EMBODIMENTS

Figure 1:
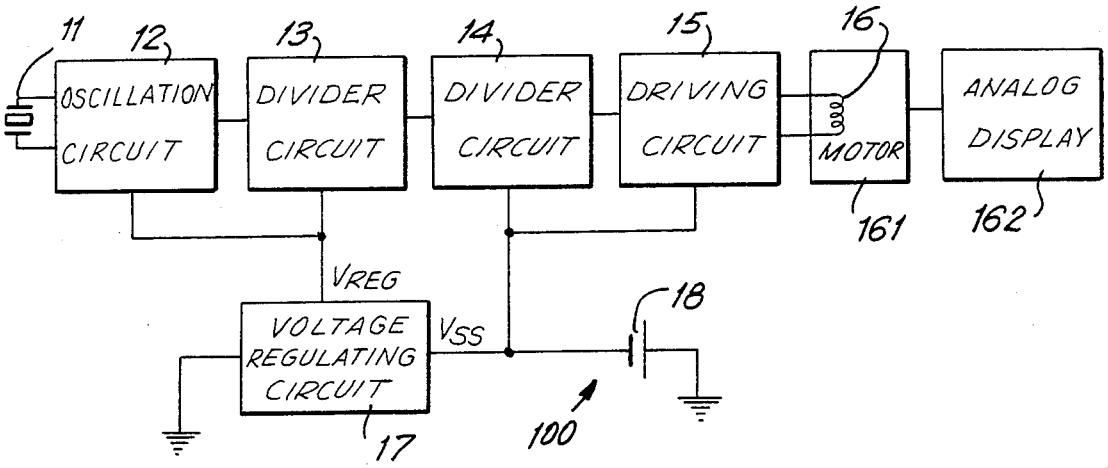
FIG. 1 is a block diagram of an analog timepiece in accordance with the present invention.

Reference is made to FIG. 1 wherein a block diagram of a battery powered analog electronic timepiece generally indicated as 100, constructed in accordance with the invention is depicted. A quartz crystal oscillator 11 in conjunction with an oscillation circuit 12 produces a reference signal. The reference signal is generally a very high frequency signal, i.e. a signal which must be divided to produce a lower frequency 1 Hz signal for driving the hands. A divider circuit 13 coupled to oscillation circuit 12 receives the reference signal and produces a divided signal. A second divider circuit 14 receives the divided signal and produces a low frequency signal.

Power is supplied to operate timepiece 100 by a battery 18. Battery 18 is shown as a 3 volt power supply but may be of varying voltage. As will be discussed in greater detail below, a voltage regulating circuit 17 receives a battery voltage $V_{SS}$ and produces a regulated voltage. A driving circuit 15 receives the low frequency signal and produces a motor driving pulse 21. A motor 16 for driving the analog display 162 contains a coil 16 which receives motor driving pulse 121 activating the motor. Current consumption becomes too great if the battery voltage $V_{SS}$ is directly applied to oscillation circuit 12 or divider circuit 13 resulting in a shortened battery life. Therefore a voltage regulating circuit 17 provides a voltage $V_{REG}$ to oscillation circuit 12 or divider circuit 13 which is lower than the battery voltage $V_{SS}$.

In an exemplary embodiment, battery 18 is a 3 volt lithium battery with a maximum internal resistance of about 1KΩ. When battery 18 is electrically coupled to a circuit with a pure resistor having a resistance of 2KΩ, the time constant of the voltage reduction is greater than 200 μsec. Voltage reduction of the battery refers to the internal voltage drop in the battery which effectively reduces the voltage drop across the terminals of the battery. It is under this reduced voltage condition that divider circuit 13 can malfunction. The time constant for restoring the voltage of battery 18 after the pure resistor is removed is also greater than 200μsec. The time constants for reducing and restoring the battery voltage are determined by the speed of the chemical reaction within the battery. The DC resistance of coil 16 is 2KΩ.

Figure 2:
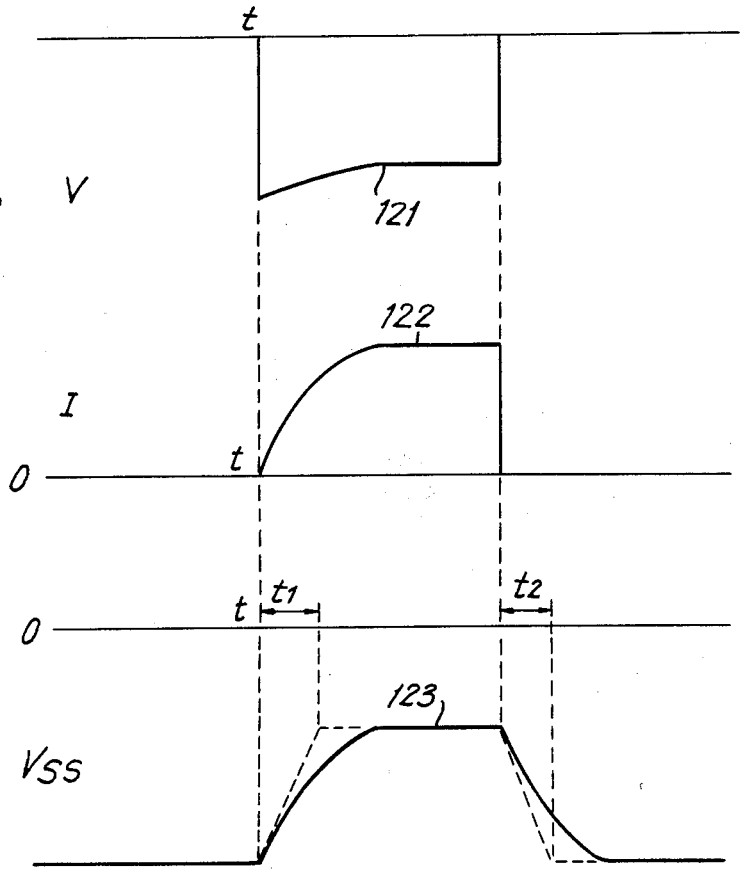
FIG. 2 is a graphical representation depicting the voltage waveform of the motor driving pulse, the current waveform of the motor coil and the voltage waveform of the battery over time.

Reference is now made to FIG. 2 wherein a voltage waveform 121 of the motor driving pulse transmitted to coil 16, a waveform 122 of the current applied to coil 16 and a voltage waveform 123 of battery 18 all in relation to a common time base are shown. As coil current 122 is applied to coil 16 as a result of base driving pulse 121, the battery voltage $V_{SS}$ 123 decreases in accordance with the internal resistance of battery 18. Upon completion of motor driving pulse 121, coil current 122 is cut off and battery voltage $V_{SS}$ returns to its original level. The voltage regulation circuit can not be operated in this manner when large and sudden changes in the voltage occur. The primeal timepiece of this type caused malfunctions in divider circuit 13 when large dips in regulated voltage occurred. Then variations in voltage are inherent to batteries under varying environmental conditions.

Figure 3:
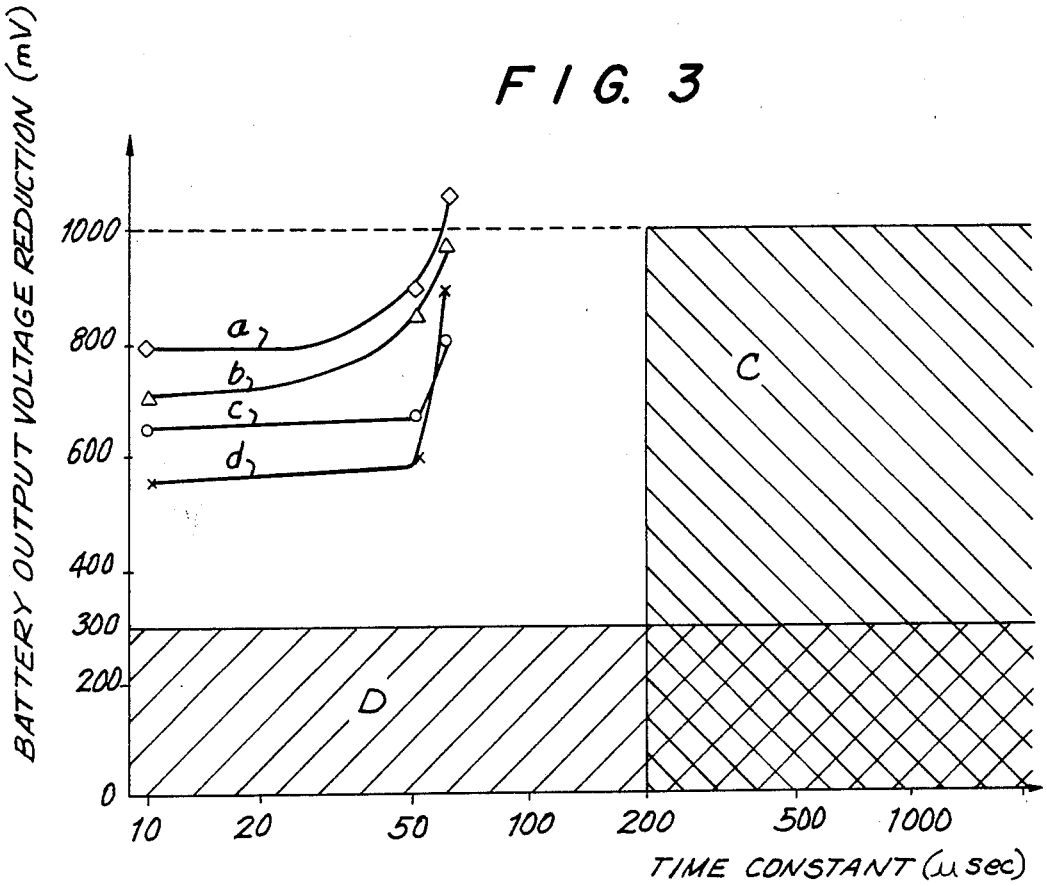
FIG. 3 is a graphical representation showing the relationship between the time constant of a variety of voltage sources and the minimum reduced voltage causing malfunction of a timepiece.

Reference is now made to FIG. 3 wherein the voltage variation time constants for the variation of voltage of the power source and the minimum values of reduced voltage which causes a variety of integrated circuits (a, b, c, d,) to malfunction for several analog timepieces is shown. If the output voltage of the battery drops more then a minimum amount there is a chance of malfunction. Curves a, b, c, d represent minimum malfunction curves for time-keeping circuits. At greater output voltage reductions and shorter time constants, i.e. above the minimum curves, malfunctions are even more likely to occur. The time constants in FIG. 3 are $t_1$ and $t_2$ of FIG. 2, and $t_1$ equals $t_2$. $t_1$ is the time constant which describes the time over which the output voltage decreases. This is to be compared with the time constant of coil 16. To operate properly $t_1$ must be sufficiently long so as to fully charge coil 16 at an adequate voltage. The power source is a three volt battery having an internal resistance less than 1KΩ. The DC resistance of the coil is 2KΩ, so that the maximum value of the reduced voltage drop within the battery is approximately 1 volt.

As is, apparent from FIG. 3, when the time constant is less than 100μsec a reduction of battery output voltage by as little as 600 mV causes the circuits to malfunction. When the time constant is greater than or equal to 100 μsec, no malfunctioning occurs even when the battery output voltage is reduced by as much as 1 volt. When the voltage is reduced by more than one volt, the timepiece circuits may malfunction.

However, drops in output voltage of more than 1 volt are prevented due to the internal resistence of the batter being less than 1K while the DC resistance of the coil is 2K where the battery voltage is 3V, less than one-third of the voltage drop will occur in the battery. As the time constant $t_1$ includes the both time constant of the battery and the coil as depicted in FIG. 2, therefore, the time constant $t_1$ is comparatively large thereby preventing any malfunction of the voltage regulating circuit. However, the time constant $t_2$ as depicted in FIG. 3 is determined when coil current 122 is shut off, and therefore is determined by the internal capacity of battery 18 resulting in a comparatively small value for the time constant $t_1$. Accordingly, some malfunctioning of the voltage regulating circuit may be caused. The present invention provides a stabilizing voltage regulating circuit 17 to prevent such malfunction.

Figure 4:
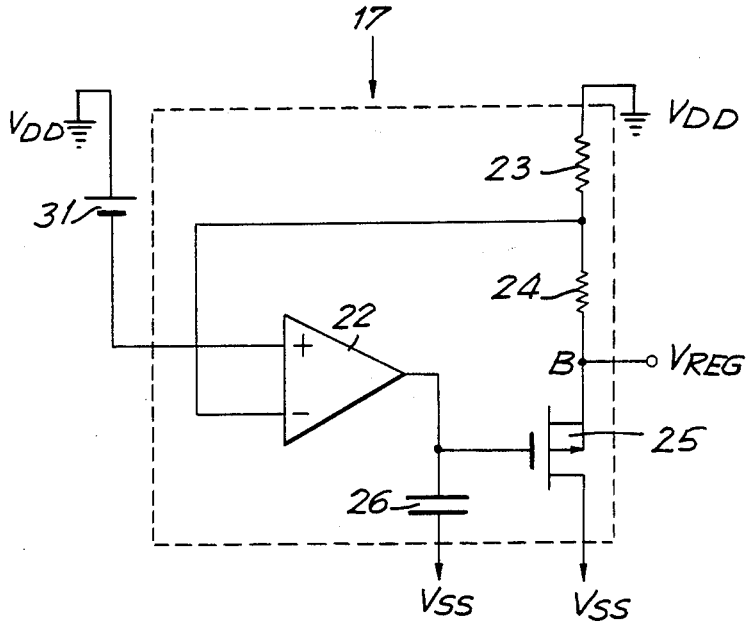
FIG. 4 is a circuit diagram of a voltage regulating circuit constructed in accordance with the present invention.

Reference is now made to FIG. 4 wherein a voltage regulating circuit, generally indicated as 17, constructed in accordance with a preferred embodiment of the present invention is depicted. Regulator circuit 17 includes a voltage comparator 22, resistors 23, 24. P channel MOS transistor 25 and capacitor 26. Resistor 23, resistor 24 and the source-drain path of transistor 25 are coupled between $V_{DD}$, an internal ground, and $V_{SS}$, the output voltage of battery 18. The inverting input of voltage comparator 22 is coupled to the junction A between resistors 23 and 24. The converting input of voltage comparator 22 receives a reference voltage from reference voltage source 31. Reference voltage source 31 utilizes known circuits which can include a transistor, a diode or other elements to produce a reference voltage. The reference voltage is set to the desired regulated voltage. The output of voltage comparator 22 is coupled to the gate electrode of transistor 25. A capacitor 26 is coupled between $V_{SS}$ and the junction of the gate electrode of transistor 25 and the output of comparator 22, to stabilize the gate voltage of transistor 25. The circuit 17 will operate without capacitor 26. Capacitor 26 is formed on the integrated circuit with the other components. The voltage at the junction B between resistor 24 and transistor 25, is the regulated voltage $V_{REG}$.

During operation of voltage regulating circuit 17, when the regulated voltage output increases and the voltage at point A becomes greater than the reference voltage, the output of comparator 22 becomes negative, proportional to the variation in regulated voltage output. This decreases the resistance of transistor 25 which in turn reduces $V_{REG}$ to the desired value. On the other hand, when the regulated voltage output decreases and the voltage at point A becomes less than the reference voltage, the output of the comparator 22 becomes positive in proportion to the variation in regulated voltage output. The resistance of transistor 25 becomes larger and the regulated output voltage $V_{REG}$ increases to the desired value. Accordingly, voltage regulating circuit 17 maintains a uniform output voltage $V_{REG}$.

However, if battery output voltage $V_{SS}$ changes, the gate voltage of transistor 25 follows and changes drastically. To prevent unstable operation of regulating circuit 17 as a result of sudden changes of voltage $V_{SS}$, a 3 pF capacitor 26 is provided between the gate electrode of transistor 25 and the battery voltage $V_{SS}$. Where a lithium battery is utilized as the power source, the internal resistance of battery 18 can be very large, which corresponds to a substantial voltage reduction which overwhelms the compensation capabilities of circuit 17.

Therefore, comparator 22 can not operate as described above. The swings in voltage with the lithium batteries, due to their high internal resistance, are so substantial that an internal capacitor 26 of sufficient capacitance can not be formed and an external, seperate component capacitor is required to stabilize voltage regulating circuit 17. Accordingly, malfunction of the timepiece circuit may still be caused due to large changes in the regulated output voltage $V_{REG}$ as $V_{SS}$ varies under operation.

Reference is again made to FIG. 3 wherein the battery output voltage reduction and time constant values which avoid malfunction of divider circuit 13 are shown. A shaded portion C shows a range of time constant and voltage reduction levels in which the malfunction of divider circuit 13 is avoided. Where the internal resistance $R_B$ of the battery is less than 1KΩ, and the DC resistance of coil 16 $R_L$ is 2KΩ, the time constants of reducing the battery voltage $t_1$ (i.e. the constant of FIG. 3), and restoring the battery voltage to its initial value $t_2$, which are equal is greater than 200μsec. As can be seen from the graph, as shaded portion C, when the battery reduction voltage time constant is more than 200 μsec and the reduction voltage is less than 1 V, malfunctions of the integrated circuits are prevented.

Motor coil 16 generally has a resistance between about 1 and 10KΩ. When the DC resistance of coil 16 is 1KΩ, if the internal resistance of the battery is less than 100Ω the reduction of the battery's output voltage is less than 300 mv. As shown by the shaded region D, malfunctions of the integrated circuit do not occur in region D regardless of the time constant. When the internal resistance of three volt battery 18 is greater than 100Ω, the battery output voltage reduction time constant $t_1$ as motor driving pulse 121 is output and the battery voltage restoration time constant $t_2$ after completion of outputting pulse 21 are both more than 200 μsec. In addition, the ratio of the internal resistance $R_B$ of the battery to the DC resistance $R_L$ is represented by the following equation:

$$R_L/R_B \geqq 2$$

That is, the DC resistance $R_L$ of coil 16 is at least twice as large as the internal resistance $R_B$ of battery 18. Under these relations, divider circuit 13 is prevented from malfunction.

Accordingly, an analog electronic timepiece which includes a voltage regulator which minimizes sudden shifts in the regulated voltage without the need for external components, such as a capacitor by adjusting the DC resistance of the coil to the range of the battery's internal resistance and by establishing voltage reduction and reconverting time constants to be greater than 200 μsec particularly where a battery with a high resistance, such as a lithium battery, is used, is provided.

It will thus be seen that the objects set forth above, among those made apparent from the preceding description, are efficiently obtained and, certain changes may be made in the above construction without departing from the spirit and scope of the invention, it is intended that all matters contained in the above description and shown in the accompanying drawings shall be interpreted as illustrative and not in a limiting sense.

It is also to be understood that the following claims are intended to cover all the generic and specific features of the invention therein described and all statements of the scope of the invention which as a matter of language might be said to fall therebetween.

What is claimed is:

1. An analog electronic timepiece to be powered by a battery, the battery having an internal resistance which may be greater than 100Ω, within a permissible range of discharge, the timepiece comprising:

oscillation means for producing a high frequency time standard signal;

divider means for dividing the high frequency time standard signal to a low frequency drive signal;

analog display means for providing a visual indication of time;

drive means, including a drive coil having an internal DC resistance, coupled to the divider means and analog display means for producing drive pulses from the low frequency drive signals to drive the analog display means, and being adapted to be powered by a battery, the battery having a first time constant associated with reduction of battery output voltage during driving pulses and a second time constant associated with restoring battery output voltage after a driving pulses, the DC resistance of the drive coil being at least twice as great as the internal resistance of the battery, the first and second constants being more than 200 μsec when the internal resistance of the battery is greater than 100Ω; and regulating means adapted to be coupled to a battery, the oscillation means and the divider means for receiving a battery output voltage and outputting a regulated voltage to the oscillation means and divider means.

2. The timepiece of claim 1 wherein the regulated voltage is less than the battery output voltage.

3. The analog electronic timepiece of claim 1 wherein the battery is a 3 volt lithium battery.

4. The analog electronic timepiece of claim 1 wherein the voltage regulating means includes a reference voltage, voltage comparator means, a voltage divider network having a tap therein and variable resistance means including a control line, the voltage comparator means comparing the reference voltage and voltage at the tap, the output of the voltage comparator being coupled to the control line, thereby producing a regulated output voltage.

5. The analog timepiece in claim 4 wherein the variable resistance means includes a P channel MOS transistor wherein a gate electrode transistor is coupled to the output voltage comparator means.

6. The analog electronic timepiece of claim 5 further including a capacitor coupled between the battery output voltage and the gate electrode of the transistor.

7. The analog electronic timepiece of claim 6 wherein the capacitor is a 3 pF capacitor formed as an integrated circuit in the remainder of the voltage regulating means.

* * * * *